US009896911B2

(12) United States Patent
Maher

(10) Patent No.: US 9,896,911 B2
(45) Date of Patent: Feb. 20, 2018

(54) SUBSEA PRESSURE PROTECTION SYSTEM

(71) Applicant: Trendsetter Vulcan Offshore, Inc., Houston, TX (US)

(72) Inventor: James V. Maher, Houston, TX (US)

(73) Assignee: Trendsetter Vulcan Offshore, Inc., Houston, TX (US)

( * ) Notice: Subject to any disclaimer, the term of this patent is extended or adjusted under 35 U.S.C. 154(b) by 0 days.

(21) Appl. No.: 15/416,505

(22) Filed: Jan. 26, 2017

(65) Prior Publication Data

US 2017/0211355 A1 Jul. 27, 2017

Related U.S. Application Data

(60) Provisional application No. 62/287,174, filed on Jan. 26, 2016.

(51) Int. Cl.

| | |
|---|---|
| ***E21B 33/035*** | (2006.01) |
| ***E21B 43/017*** | (2006.01) |
| ***E21B 41/00*** | (2006.01) |
| ***E21B 47/00*** | (2012.01) |

(52) U.S. Cl.

CPC ..... *E21B 41/0007* (2013.01); *E21B 33/035* (2013.01); *E21B 47/0001* (2013.01); *E21B 43/017* (2013.01)

(58) Field of Classification Search

CPC .. E21B 33/035; E21B 41/0007; E21B 43/017; E21B 47/0001

See application file for complete search history.

(56) References Cited

U.S. PATENT DOCUMENTS

| | | | | |
|---|---|---|---|---|
| 6,880,567 | B2 * | 4/2005 | Klaver | F16K 17/04 137/461 |
| 7,793,725 | B2 * | 9/2010 | Daniel | B63B 21/508 166/345 |
| 7,798,233 | B2 * | 9/2010 | Daniel | B63B 27/24 166/350 |
| 7,823,640 | B2 * | 11/2010 | Flanders | E21B 47/0007 166/250.01 |
| 7,857,059 | B2 * | 12/2010 | Shen | E21B 43/01 138/120 |
| 8,051,875 | B2 * | 11/2011 | Edwards | F16K 17/02 137/461 |
| 8,893,803 | B1 * | 11/2014 | Lugo | E21B 43/013 166/250.01 |

(Continued)

FOREIGN PATENT DOCUMENTS

EP 2592318 * 5/2013

*Primary Examiner* — Matthew R Buck

(74) *Attorney, Agent, or Firm* — Derek V. Forinash; Porter Hedges LLP

(57) ABSTRACT

A subsea production field has a subsea fortified zone that includes equipment designed to contain high pressure. The subsea production field also has a zone rated at lower pressure that includes equipment that is not capable of containing high pressure. A subsea pressure protection system is provided in the subsea fortified zone. The subsea pressure protection system includes a high integrity pressure protection system (HIPPS), and a pipe bundle. By selecting an appropriate length of the pipe bundle, the location of the separation between the subsea fortified zone and the zone rated at lower pressure may be kept fixed at the outlet of the pipe bundle.

12 Claims, 3 Drawing Sheets

(56) References Cited

U.S. PATENT DOCUMENTS

| | | | | |
|---|---|---|---|---|
| 2004/0031614 | A1* | 2/2004 | Kleinhans | E21B 19/002 166/355 |
| 2005/0199286 | A1* | 9/2005 | Appleford | F17D 3/00 137/487.5 |
| 2007/0095401 | A1* | 5/2007 | Webster | F16K 17/10 137/488 |
| 2010/0071775 | A1* | 3/2010 | Ratcliffe | E21B 41/0007 137/12 |
| 2011/0240157 | A1* | 10/2011 | Jones | F16K 17/02 137/613 |
| 2012/0168142 | A1* | 7/2012 | Hernandez | E21B 36/001 165/279 |
| 2016/0376875 | A1* | 12/2016 | Smith | E21B 43/013 137/15.08 |
| 2017/0089182 | A1* | 3/2017 | Witwer | E21B 17/01 |

* cited by examiner

SUBSEA PRESSURE PROTECTION SYSTEM

CROSS-REFERENCE TO RELATED APPLICATIONS

This application claims priority to U.S. provisional patent application Ser. No. 62/287,174, filed on Jan. 26, 2016 and entitled "Subsea Pressure Protection System," the content of which is incorporated herein by reference.

BACKGROUND

This disclosure relates generally to methods and apparatus for controlling pressure during hydrocarbon production. More specifically, this disclosure relates to methods and apparatus for preventing over-pressurization of equipment during hydrocarbon production.

As hydrocarbon reservoirs of increasingly high pressures are explored and developed, there are increasing demands to improve safety by providing increased control of high pressure fluids. To this end, high integrity pressure protection systems (HIPPS) have been employed in the oil and gas industry to provide a barrier between equipment designed to contain high pressure and equipment that is not capable of containing high pressure. HIPPS conventionally include one or more valves that are actuated by a control system that monitors pressure immediately upstream or downstream of the valves. When the control system senses an excessive pressure, the valves are closed as quickly as possible.

In certain subsea installations partially located on the sea floor, several wellheads, topped with wet trees, are fluidly connected to a single production manifold. The production manifold is in turn fluidly connected to a platform located on the sea surface via a flowline and a riser. The riser, is usually fluidly connected to a flare, a boarding and shut down valve (BSDV), a choke, among other components of a platform receiving system. The wellheads, the wet trees, and sometimes the production manifold coupled thereto, are designed to contain high pressure. But the flowline that couples the production manifold to the riser is rated to a pressure that is lower than the wellheads, but still higher than the flowing pressure. The pressure rating of the flowline is sometimes referred to as derated. A subsea HIPPS, also rated to high pressure, may be employed between the wellheads and the subsea manifold. The HIPPS actuates so as to automatically shut off any flow from the wellheads in response to excessive pressure. Thus the HIPPS contains excessive pressure, avoiding damaging the flowline or other equipment that is not capable of containing high pressure.

To accommodate the time that it will take to close the valves, subsea HIPPS often include a length of "high pressure" flowline designed to contain the increased pressure occurring downstream of the HIPPS until the valves can be closed. The zone equipped with high pressure flowline is referred to as the fortified zone. The length of the high pressure flowline needed and/or the size of the fortified zone are dependent on the operating speed of the HIPPS as well as the expected flow conditions. In certain applications, the length of the high pressure flowline may be several hundred and even several thousand feet long. Accommodating such length of high pressure flowline makes installation of subsea equipment challenging, in particular because of the large, and variable distances between the wellheads and the production manifold that are needed to dispose the required length of high pressure flowline. Also, retrofitting a subsea HIPPS to an existing facility without modifying its layout is usually not feasible.

Thus, there is a continuing need in the art for methods and apparatus for providing increased safety and containment of high pressure in hydrocarbon exploration and production.

BRIEF SUMMARY OF THE DISCLOSURE

A subsea pressure protection system coupled to a wet tree located on a sea floor comprises a high integrity pressure protection system including a pressure sensor, a plurality of valves, and a logic controller communicatively coupled to the pressure sensor and operable to close one or more of the plurality of valves upon sensing a pressure above a preset level. The subsea protection system further comprises a pipe bundle fluidly connected downstream of at least one of the plurality of valves. The pipe bundle comprises one or more coiled sections.

In some embodiments, the high integrity pressure protection system is removably coupled to a skid located on the sea floor. The pipe bundle may also be removably coupled to a skid. One of the plurality of valves may be fluidly connected downstream of the pipe bundle. The one or more coiled sections forming the pipe bundle are preferably terminated by high strength mechanical connectors which are not assembled by welding.

In another aspect, a subsea production system comprises at least one wet tree topping one well head located on a sea floor, a production manifold located on the sea floor, and a subsea protection system coupled between the at least one wet tree and the production manifold. The subsea protection system includes a pressure sensor, a plurality of valves, a logic controller communicatively coupled to the pressure sensor and operable to close one or more of the plurality of valves upon sensing a pressure above a preset level, and a first pipe bundle fluidly connected downstream of at least one of the plurality of valves and having one or more coiled sections. The subsea production system further comprises a platform receiving system coupled to the production manifold via a riser.

In some embodiments, the subsea protection system may be removably coupled to a skid located on the sea floor. The subsea production system may further comprise a second pipe bundle located on the platform receiving system. The second pipe bundle may be fluidly coupled to the riser. The subsea production system may further comprise a choke located on the platform receiving system. The second pipe bundle may be connected upstream of the choke. One of the plurality of valves may be fluidly connected downstream of the first pipe bundle.

A method of protecting equipment in a zone rated at low pressure against high pressure surges involves coupling a subsea protection system between at least one wet tree and a production manifold. The subsea protection system includes a pressure sensor, a plurality of valves, a logic controller communicatively coupled to the pressure sensor, and a first pipe bundle fluidly connected downstream of at least one of the plurality of valves and having one or more coiled sections. The method further involves operating the logic controller to close one or more of the plurality of valves upon sensing a pressure above a preset level. The method still further involves dissipating the high pressure surges in the first pipe bundle and upstream of the production manifold.

In some embodiments, one of the plurality of valves may be fluidly connected downstream of the first pipe bundle. The method may further involve operating the logic controller to close the one or more of the plurality of valves fluidly connected downstream of the first pipe bundle. The method may further involve coupling a second pipe bundle to a riser and upstream of a boarding and shut down valve located on a platform receiving system. The method may further involve closing the boarding and shut down valve. Coupling the subsea protection system between the at least one wet tree and the production manifold may be performed with a crane in a single lift.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
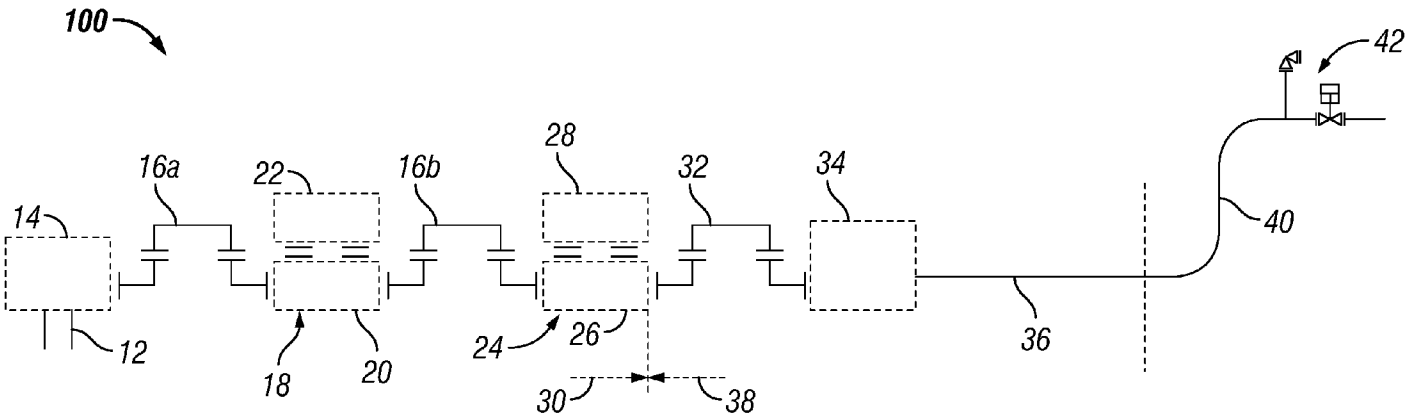
FIG. 1 is a schematic view of a subsea production field including an embodiment of a subsea pressure protection system.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Referring initially to FIG. 1, a subsea production field comprises a wellhead 12, topped with a wet tree 14, and a production manifold 34. The wellhead 12, the wet tree 14, and the production manifold 34 are located on a sea bed. While only one wellhead 12 and one wet tree 14 are shown connected to the production manifold 34 in FIG. 1, several wellheads and wet trees are usually fluidly connected to the same production manifold. The production manifold 34 may be fluidly connected to a platform receiving system 42 via a flowline 36 and a riser 40. The platform receiving system 42 may include pressure and flow control components, such as a BSDV or choke, as further discussed hereinafter.

The subsea production field comprises a subsea fortified zone 30 that includes equipment designed to contain high pressure. For example, the type of material making the pipes, and the type of connection between the pipes are selected to contain high pressure fluids (e.g., fluids at pressure in excess of 15,000 psi), even if such pressure levels are not expected during normal production conditions and may only occur in exceptional circumstances.

In many circumstances it would be economically or physically impractical to extend the subsea fortified zone 30 the entire distance from the wellhead 12 to the platform receiving system 42. Accordingly, the subsea production field also comprises a zone 38 rated at lower pressure that includes equipment that is not capable of containing high pressure. For example, the type of material making the pipes, and the type of connection between the pipes may be less expensive, lighter weight, and easier to assemble than the type of material making the pipes and connections between the pipes in the subsea fortified zone 30. In the example shown in FIG. 1, the zone 38 that is rated at lower pressure comprises the production manifold 34, and the flowline 36.

An embodiment of a subsea pressure protection system 100 is provided in the subsea fortified zone 30. The subsea pressure protection system 100 comprises a HIPPS 22 and a pipe bundle 28. As will become apparent, by selecting an appropriate length of the pipe bundle 28, the location of the separation between the subsea fortified zone 30 and the zone 38 rated at lower pressure may be kept fixed at the outlet of the pipe bundle 28.

In the example shown in FIG. 1, the HIPPS 22 and the pipe bundle 28 are removably mounted on skids 18 and 24, respectively. However the pipe bundle 28 may, in other examples, be fixedly mounted. The skids 18 and 24 may be made of a steel frame on which equipment (e.g., the HIPPS 22 or the pipe bundle 28) is mounted to facilitate handling and installation of such equipment. The skids 18 and 24 may comprise bases 20 and 26, respectively, which are fluidly connected to other elements of the subsea production field by jumpers, such as jumpers 16*a* and 16*b*, that are designed to contain high pressure, or jumper 32, that may not be capable of containing high pressure. In other examples, the HIPPS 22 and the pipe bundle 28 may not be mounted on skids.

The installation or removal of the subsea pressure protection system 100 is facilitated by its compactness. The jumpers 16*b* and 32 may typically span over a length of approximately 100 feet, and thus the HIPPS 22 and the production manifold may be located within a distance of approximately 200 feet. It should be noted however that jumpers may span over shorter or longer lengths, so that the resulting distance between the HIPPS 22 and the manifold may significantly differ from 200 feet. Further, the pipe bundle 28 that is mounted on the skid 24 may be installed with a crane in a single lift, regardless of the length of the pipe bundle 28. Still further, the location of the production manifold 34 relative to the wellhead 12 (and the other wellheads to which the manifold may be connected) may be independent of the variable length of the pipe bundle 28.

Figure 2:
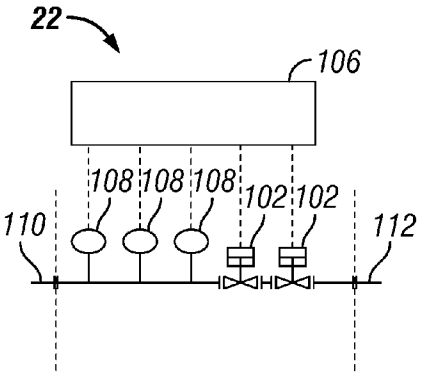
FIG. 2 is a schematic view of a portion of the subsea pressure protection system shown in FIG. 1 and including a high integrity pressure protection system (HIPPS).

Turning now to FIG. 2, the HIPPS 22 includes valves 102, logic controller 106, and pressure sensors 108. Valves 102 are connected in series between inlet 110 coupled to the wet tree 14 (in FIG. 1), and outlet 112 coupled to the production manifold 34 (in FIG. 1). The valves 102 may be high-pressure gate valves, or some other type of valve, that can shut off flow through the subsea pressure protection system 100 and are rated to handle high pressure that may escape from the wet tree 14. Pressure sensors 108 are disposed upstream and optionally downstream of valves 102, and are operable to measure the pressure within the pressure protection system 100. Pressure sensors 108 are operably coupled to the logic controller 106. The logic controller 106 is programmed to monitor the pressure measured by pressure sensors 108. If the pressure measured by pressure sensors 108 exceeds a preset level (e.g., the pressure rating of zone 38), the logic controller 106 sends a signal that closes one or more valves 102. Once the one or more valves 102 are closed, the production manifold 34 is isolated from the wet tree 14.

Figure 3:
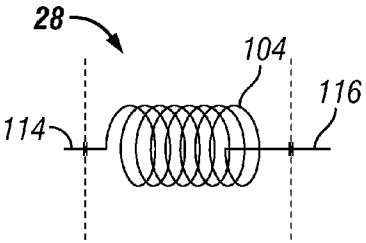
FIG. 3 is a schematic view of another portion of the subsea pressure protection system shown in FIG. 1 and including a pipe bundle.

Turning now to FIG. 3, the pipe bundle 28 comprises a length of continuous pipe or tubing 104 that is connected between inlet 114 coupled to HIPPS 22 (in FIG. 1), and outlet 116 coupled to production manifold 34 (in FIG. 1). The pipe or tubing 104 may be made of high strength steel or other alloy that is rated to handle the high pressure that may escape from the wet tree 14, and has a length sufficient to contain an increased pressure in the pipe or tubing 104 until the valves 102 can be closed.

Two or more portions of the pipe or tubing 104 overlap or are doubled, such as by coiling, looping, folding or wrapping. The pipe bundle 28 is formed by bending the pipe, and is preferably not but may also be formed by connecting preformed coiled sections terminated by high strength mechanical connections, some of which being preformed with a curved shape, or by a combination of both bending and assembling. To maintain high pressure rating of the pipe bundle, the pipe sections are preferably not welded. In any case, the pipe bundle 28 is more compact than a straight pipe having the same length as the pipe bundle 28. In certain embodiments, the pipe bundle 28 may comprise a length of pipe or tubing that has been rolled into a substantially cylindrical coil, a substantially oval coil, a spiral coil, a coil made of a stack of spirals, or a coil having another shape.

In operation, one or more of the pressure sensors 108 may continuously monitor the pressure of the fluid flowing from the wet tree 14. The pressure sensors 108 are communicatively coupled to the logic controller 106. Upon sensing a pressure above a preset level, the logic controller 106 closes one or more valves 102. When the one or more valves 102 are closed, the overpressure may have entered the pipe bundle 28, but it starts dissipating upon closure of the one or more valves 102. The pipe bundle 28 is long enough so that the overpressure has dissipated at the outlet of the pipe bundle 28, and the pressure does not exceed the pressure rating in the zone 38.

Figure 4:
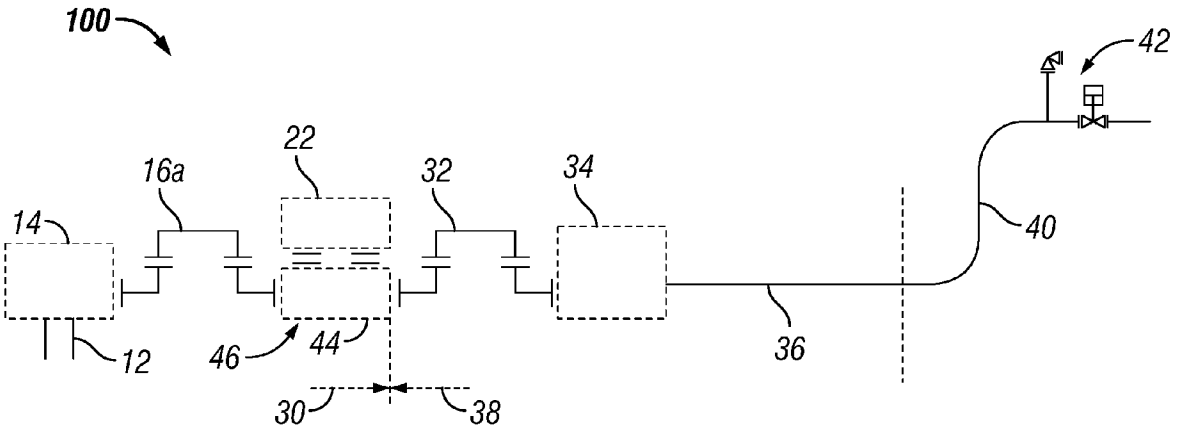
FIG. 4 is a schematic view of a subsea production field including another embodiment of a subsea pressure protection system.

Turning to FIG. 4, another embodiment of the subsea pressure protection system 100 is provided in the subsea fortified zone 30. The subsea pressure protection system 100 comprises a HIPPS 22 removably mounted on a spool base 44 of a skid 46, and a pipe bundle integrated in the spool base 44. In this embodiment, the HIPPS 22 and the production manifold 34 may be located within a distance of approximately 100 feet. Further, the HIPPS 22 and the pipe bundle are provided on the same skid 46. Thus, valves that are driven by the same logic controller may be disposed upstream and downstream of the pipe bundle, as illustrated in FIG. 5.

Figure 5:
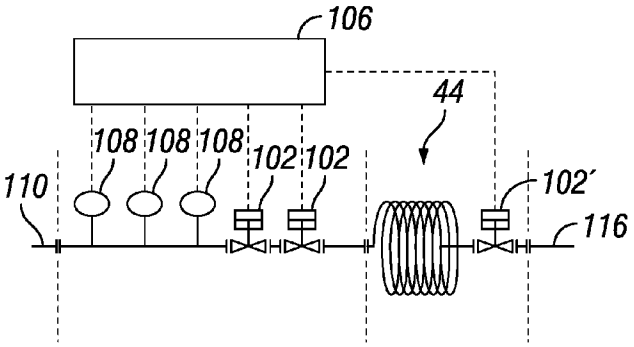
FIG. 5 is a schematic view of a portion of the subsea pressure protection system shown in FIG. 4.

Turning to FIG. 5, a valve 102' that is coupled downstream of the spool base 44 may be provided in the HIPPS 22 adjacent the separation between the subsea fortified zone 30 and the zone 38 rated at lower pressure. The valve 102' is preferably driven by the logic controller 106 that also drives the valves 102 that are fluidly coupled upstream of the spool base 44. The valve 102' may be provided by adding another valve or relocate one of the valves 102 to a position that is downstream of the spool base 44.

In operation, valve 102' may also be operated by the logic controller 106 and be closed upon one of the pressure sensors 108 sensing a pressure above a preset level. The valve 102' may provide an additional barrier between equipment designed to contain high pressure and equipment that is not capable of containing high pressure.

Figure 6:
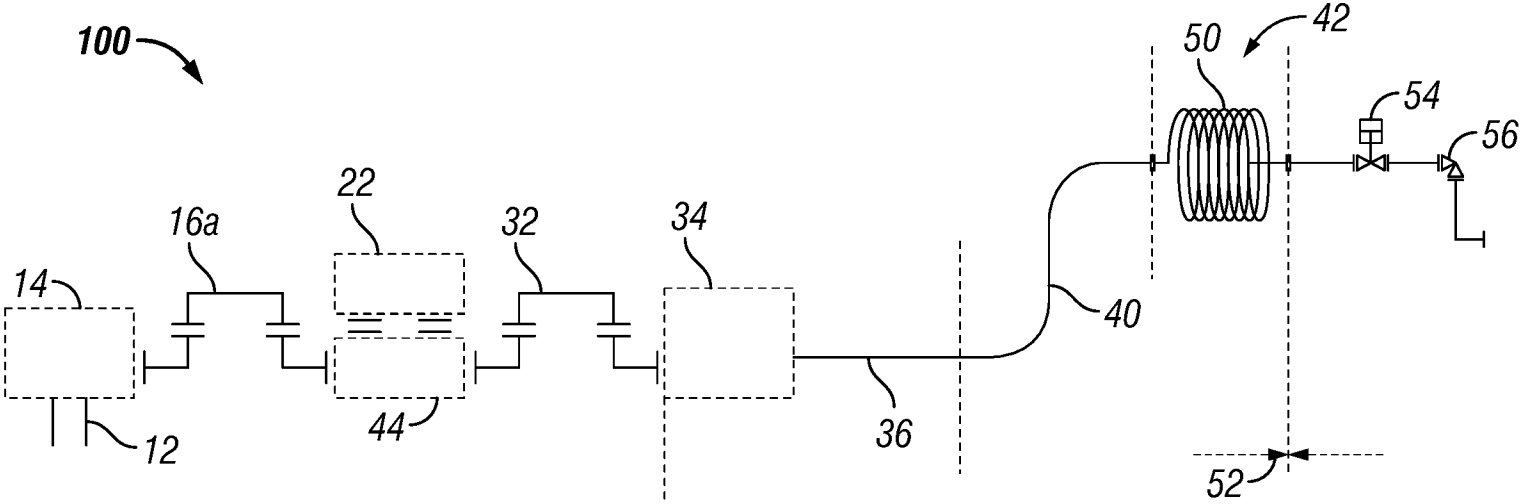
FIG. 6 is a schematic view of a subsea production field including yet another embodiment of a subsea pressure protection system.

Turning now to FIG. 6, to accommodate transient overpressure occurring on the platform receiving system 42, for example upstream of a choke 56, a riser 40 rated at higher pressures, and pipe sections also rated at higher pressures, welded between the riser 40 and the BSDV 54, or between the BSDV 54 and the choke 56 may be needed. As such, subsea HIPPS 22 may not completely eliminate the need of equipment designed to contain high pressure downstream of the production manifold 34.

In yet another embodiment of the subsea pressure protection system 100 shown in FIG. 6, a pipe bundle 50 is provided on the platform receiving system 42 upstream of the choke 56. The pipe bundle 50 may be rated at a shut-in pressure that is higher than the flowing pressure. In the example of FIG. 6, the pipe bundle 50 is coupled between the riser 40 and the BSDV 54, however, the pipe bundle 50 may be coupled elsewhere between the riser 40 and the choke 56. In any case, the pipe bundle 50 provides an extended length of pipe in a zone 52 rated at shut-in pressure.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A subsea pressure protection system for coupling to a wet tree located on a sea floor, comprising:

a high integrity pressure protection system including a pressure sensor, a plurality of valves, and a logic controller communicatively coupled to the pressure sensor and to each of the plurality of valves, the logic controller being operable to close one or more of the plurality of valves upon sensing a pressure above a preset level; and a pipe bundle fluidly connected downstream of at least a first one of the plurality of valves and comprising one or more coiled sections, wherein at least a second one of the plurality of valves is fluidly connected downstream of the pipe bundle.

2. The subsea pressure protection system of claim 1, wherein the high integrity pressure protection system is removably coupled to a skid located on the sea floor.

3. The subsea pressure protection system of claim 1, wherein the pipe bundle is removably coupled to a skid located on the sea floor.

4. The subsea pressure protection system of claim 1, wherein the one or more coiled sections is terminated with high strength mechanical connectors which are not assembled by welding.

5. The subsea pressure protection system of claim 1, wherein at least a third one of the plurality of valves is fluidly connected upstream of the pipe bundle.

6. A subsea production system, comprising:

at least one wet tree topping one well head located on a sea floor;

a production manifold located on the sea floor;

a subsea protection system coupled between the at least one wet tree and the production manifold, the subsea protection system including a pressure sensor, a plurality of valves, a logic controller communicatively coupled to the pressure sensor and to each of the plurality of valves, the logic controller being operable to close one or more of the plurality of valves upon sensing a pressure above a preset level, and a first pipe bundle fluidly connected downstream of at least a first one of the plurality of valves, wherein the first pipe bundle has one or more coiled sections rated at a high pressure;

a platform receiving system coupled to the production manifold via a riser;

a flowline coupling the production manifold to the riser, wherein the flowline is rated at a flowing pressure that is lower than the high pressure; and a second pipe bundle located on the platform receiving system, wherein the second pipe bundle is fluidly coupled downstream of the riser.

7. The subsea production system of claim 6, wherein the subsea protection system is removably coupled to a skid located on the sea floor.

8. The subsea production system of claim 6, further comprising a choke located on the platform receiving system, wherein the second pipe bundle is connected upstream of the choke.

9. The subsea production system of claim 6, wherein at least a second one of the plurality of valves is fluidly connected downstream of the first pipe bundle.

10. A method of protecting equipment in a zone rated at low pressure against high pressure surges, the method comprising:

coupling a subsea protection system between at least one wet tree and a production manifold, wherein the subsea protection system includes a pressure sensor, a plurality of valves, a logic controller communicatively coupled to the pressure sensor and to each of the plurality of valves, and a first pipe bundle fluidly connected downstream of at least a first one of the plurality of valves and upstream of at least a second one of the plurality of valves, wherein the first pipe bundle has one or more coiled sections;

operating the logic controller to close one or more of the plurality of valves upon sensing a pressure above a preset level;

dissipating the high pressure surges in the first pipe bundle and upstream of the production manifold; and operating the logic controller to close the at least second one of the plurality of valves.

11. The method of claim 10, further comprising:

flowing fluid in a flowline coupling the production manifold to a riser, wherein the flowline is rated at a flowing pressure that is lower than a pressure rating of the first pipe bundle; coupling a second pipe bundle to the riser and upstream of a boarding and shut down valve located on a platform receiving system; and closing the boarding and shut down valve.

12. The method of claim 10, wherein coupling the subsea protection system between the at least one wet tree and the production manifold is performed with a crane in a single lift.

* * * * *